US012690674B2

(12) United States Patent
Beeri

(10) Patent No.: US 12,690,674 B2
(45) Date of Patent: Jul. 28, 2026

(54) PORTABLE COOKING KITCHEN WITH REDUCED STORAGE SPACE

(71) Applicant: Yehoyada Beeri, Moreshet (IL)

(72) Inventor: Yehoyada Beeri, Moreshet (IL)

( * ) Notice: Subject to any disclaimer, the term of this patent is extended or adjusted under 35 U.S.C. 154(b) by 107 days.

(21) Appl. No.: 18/317,085

(22) Filed: May 14, 2023

(65) Prior Publication Data

US 2023/0371688 A1 Nov. 23, 2023

(30) Foreign Application Priority Data

May 22, 2022 (IL) ..... 293277

(51) Int. Cl.
*A47B 77/02* (2006.01)

(52) U.S. Cl.
CPC ..... *A47B 77/02* (2013.01)

(58) Field of Classification Search
CPC ..... A47B 77/02; A47B 77/06; A47B 77/08; A47B 77/14; A47B 77/18; A47B 47/0075
See application file for complete search history.

(56) References Cited

U.S. PATENT DOCUMENTS 1,452,117 A * 4/1923 Lora ..... A47B 77/10 312/282
3,051,160 A * 8/1962 Nielsen ..... A47B 77/08 312/203
4,807,764 A * 2/1989 Bellin ..... A47B 88/407 211/94.01
6,752,477 B2 * 6/2004 Goldberg ..... A47B 21/00 312/351.1
2003/0234600 A1 * 12/2003 Helver ..... A47B 77/18 312/270.3
2008/0163564 A1 * 7/2008 Jarski ..... A47B 43/00 52/79.5
2009/0134751 A1 * 5/2009 Ingjaldsdottir ..... A47C 15/004 312/237

FOREIGN PATENT DOCUMENTS

CN 205678717 U 11/2016
CN 111887618 A * 11/2020 ..... A47B 77/08
EP 3228218 10/2017
WO 2017/221116 12/2017

* cited by examiner

*Primary Examiner* — Matthew W Ing
(74) *Attorney, Agent, or Firm* — Dekel Patent Ltd.; David Klein

(57) ABSTRACT

A method includes providing a kitchen assembly that includes one or more supports, one or more side counters, which are supported by the one or more supports, a central counter, and a front panel positioned sideways relative to the one or more supports. There is a space adjacent the one or more side counters and behind the front panel for receiving therein a cooking appliance. The kitchen assembly is used in one of two modes: a storage mode and a usage mode. In the usage mode the central counter is placed above the space and is adjacent the one or more side counters and the front panel, and the cooking appliance is not in the space. In the storage mode the central counter is moved away from the space and the cooking appliance is positioned in the space.

8 Claims, 4 Drawing Sheets

PORTABLE COOKING KITCHEN WITH REDUCED STORAGE SPACE

FIELD OF THE INVENTION

The present invention relates generally to portable or outdoor kitchens, and particularly to a portable or outdoor cooking kitchen with reduced storage space.

BACKGROUND OF THE INVENTION

Outdoor cooking and the use of outdoor kitchens are increasingly popular because outdoor kitchens provide a gathering place for families and friends and fits with other outdoor activities, particularly during periods of good weather. Outdoor kitchen and dining areas also provide significant value to homes, both in the quality of life offered and the value and distinctiveness of the home in the real estate market.

Heretofore, outdoor cooking has been largely limited to the use of conventional gas barbecue grills. One of the disadvantages of the prior art systems is they take up a large amount of space for storage

SUMMARY OF THE INVENTION

The present invention seeks to provide an improved portable cooking kitchen with reduced storage space, as is described more in detail hereinbelow. The portable kitchen may be used outdoors for camping, or on a terrace or porch, or any other convenient place for cooking.

There is thus provided in accordance with an embodiment of the present invention a method that includes providing a kitchen assembly that includes one or more supports, one or more side counters, which are supported by the one or more supports, a central counter and a front panel positioned sideways relative to the one or more supports, wherein there is a space adjacent the one or more side counters and behind the front panel for receiving therein a cooking appliance, and instructing to use the kitchen assembly in one of two modes, a storage mode and a usage mode, wherein in the usage mode the central counter is placed above the space and is adjacent the one or more side counters and the front panel, and the cooking appliance is not in the space, and wherein in the storage mode the central counter is moved away from the space and the cooking appliance is positioned in the space.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 3A:
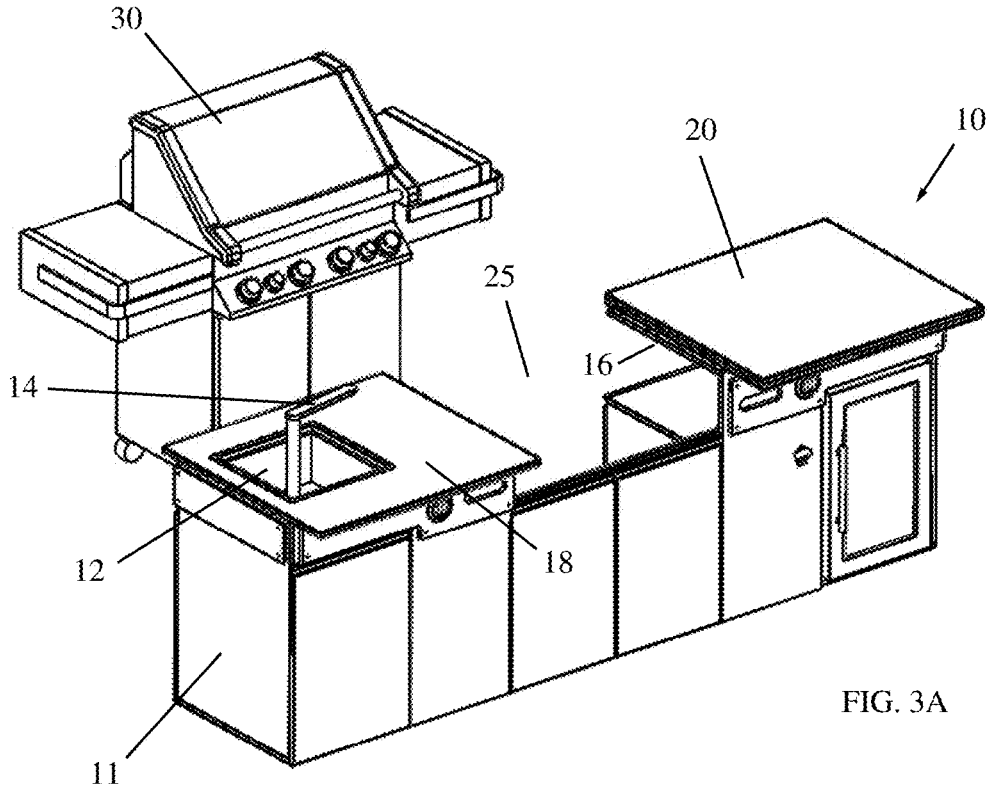
FIGS. 3A and 3B are simplified illustrations of the rear portion of the portable kitchen, in stored and expanded orientations, respectively.
Figure 3B:
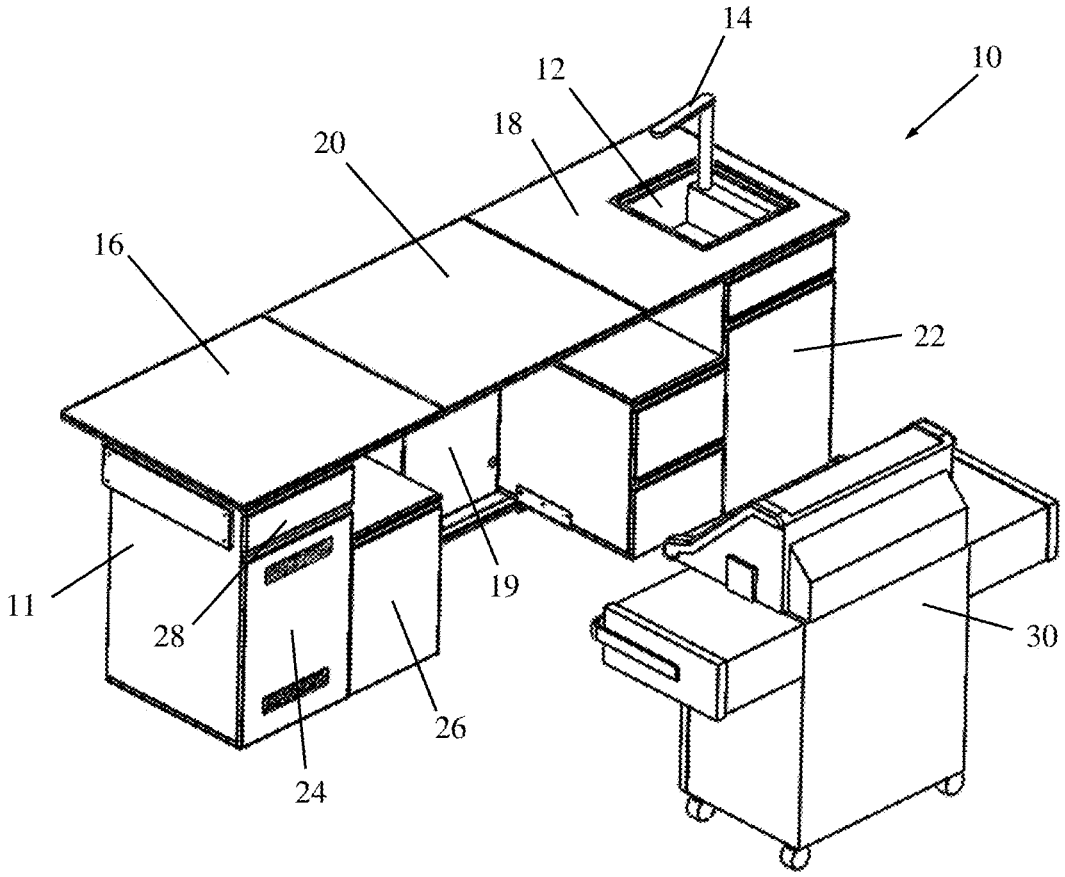

Reference is now made to FIGS. 3A and 3B, which illustrate a portable kitchen 10, constructed and operative in accordance with a non-limiting embodiment of the invention.

The portable kitchen 10 may include supports 11 (e.g., side walls or a frame) that support a sink 12, a faucet 14, one or more side counters 16 and 18, a front panel 19, a central counter 20 (which may be slidable, retractable or foldable as described below), a refrigerator or other cooling device 22, tubes or piping for water supply and drainage (not shown), cupboards or shelves 24.

The portable kitchen 10 may include (not shown) one or more lights, such as overhead lights or peripheral lights around the kitchen surfaces, kitchen or barbecue utensils (cutlery, ladles, skewers, bottle or can openers, etc.), a water tank, water pump, batteries, and other accessories.

The portable kitchen 10 may include a garbage bin 26, and a paper towel rack or rod 28.

The portable kitchen 10 may include (not shown) drainage accessories, stove accessories, food smoking accessories, an ice maker, magnets for holding knives and other kitchen accessories, cutting boards, a hood, covers for shade, cup racks, loudspeakers (e.g., with Bluetooth connection), electrical outlets and chargers.

Figure 2A:
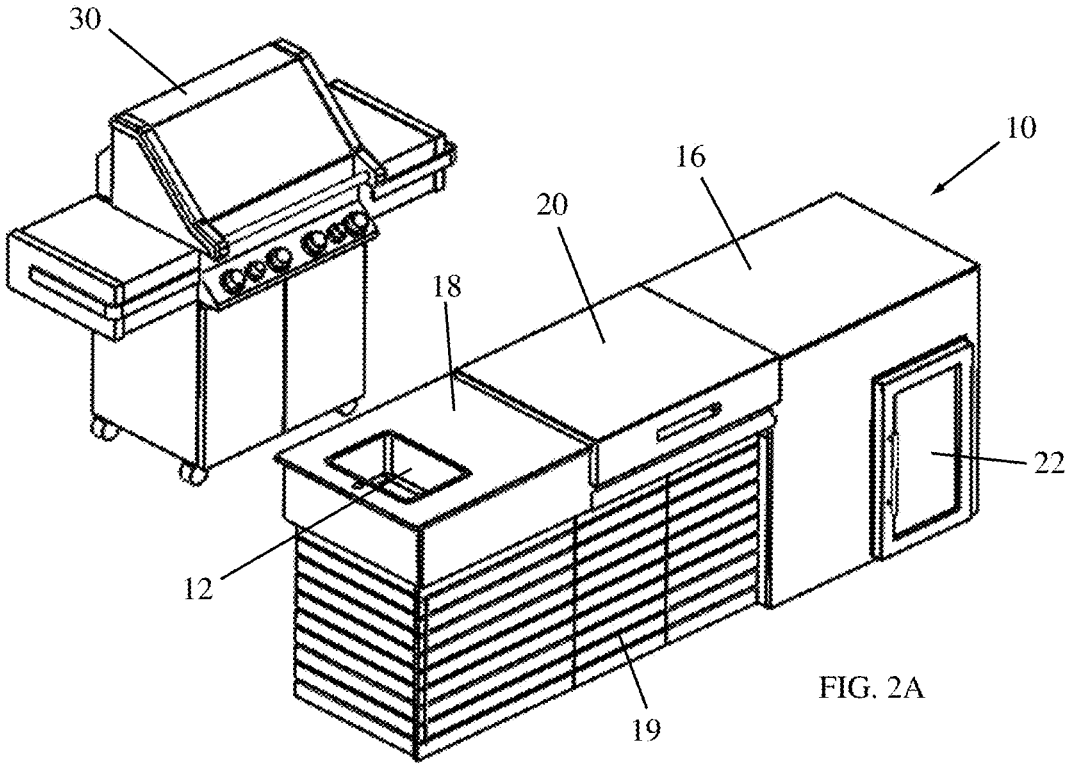
FIGS. 2A and 2B are simplified illustrations of the portable kitchen, respectively with a counter top in a position flush with side counter tops and in a position where the counter top is moved to the side to create a space for receiving a stove or grill in the stored orientation.
Figure 2B:
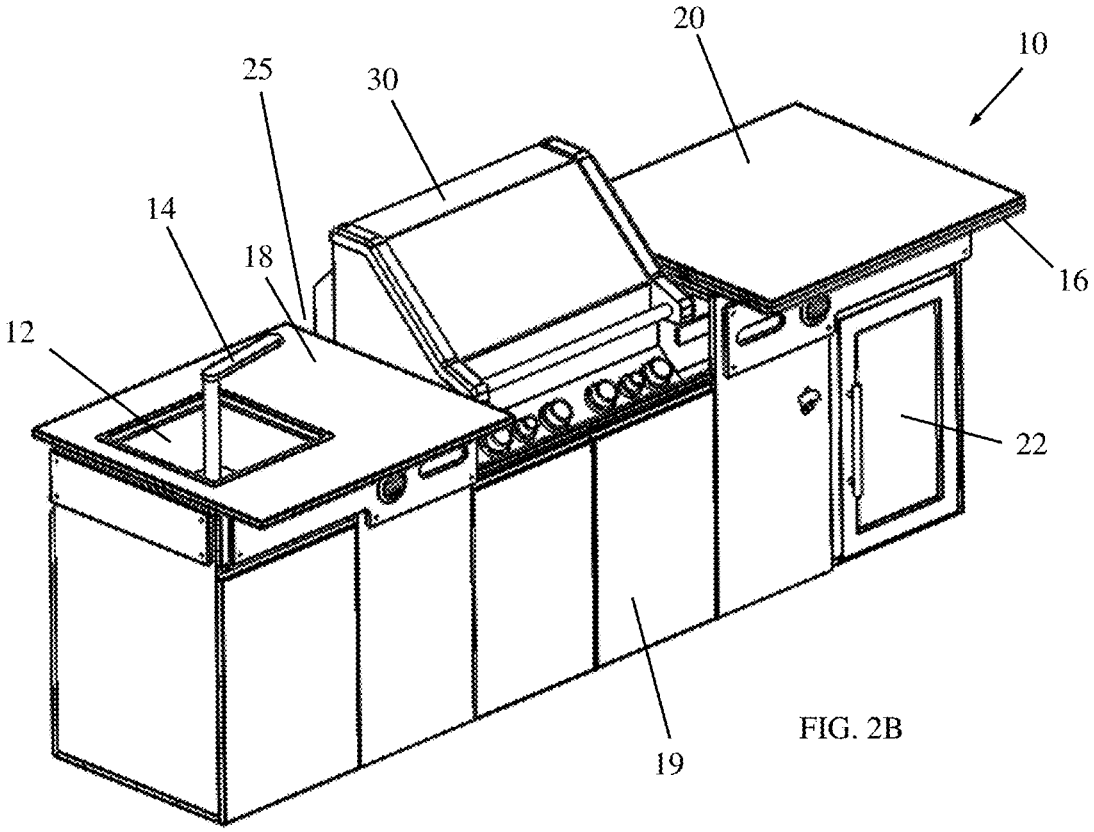

As seen in FIGS. 3A and 2B, the central counter 20 may be moved to the side over one of the side counters (such as side counter 16) to create a space 25 to receive therein a cooking appliance 30 (e.g., a stove or grill), as seen in FIG. 3A. The cooking appliance 30 may be any kind of unit for heating or preparing food, such as a stove, barbecue or oven, and may be custom-made for the kitchen if desired.

Figure 1A:
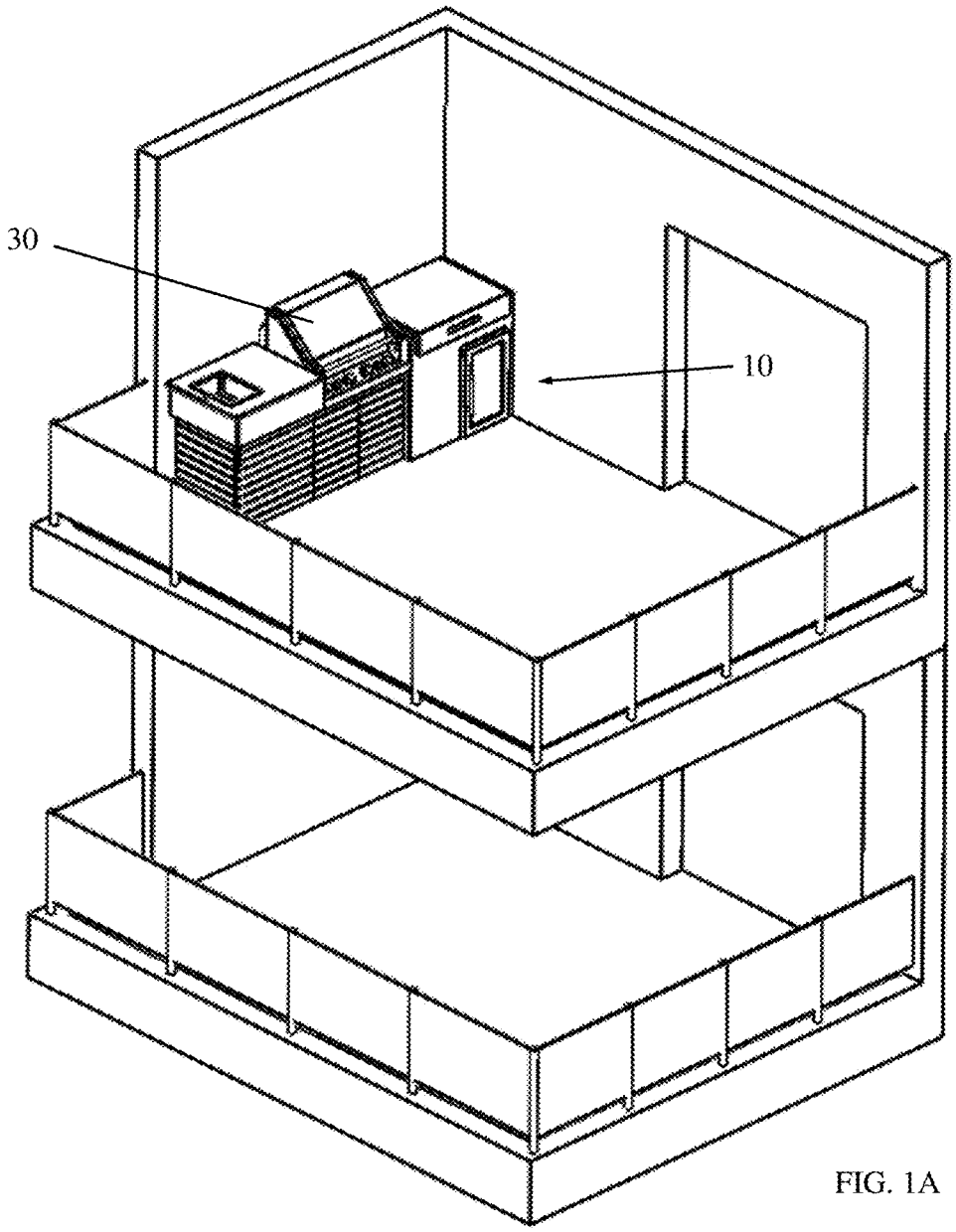
FIGS. 1A and 1B are simplified illustrations of a portable kitchen, in accordance with an embodiment of the invention, in stored and expanded orientations, respectively.
Figure 1B:
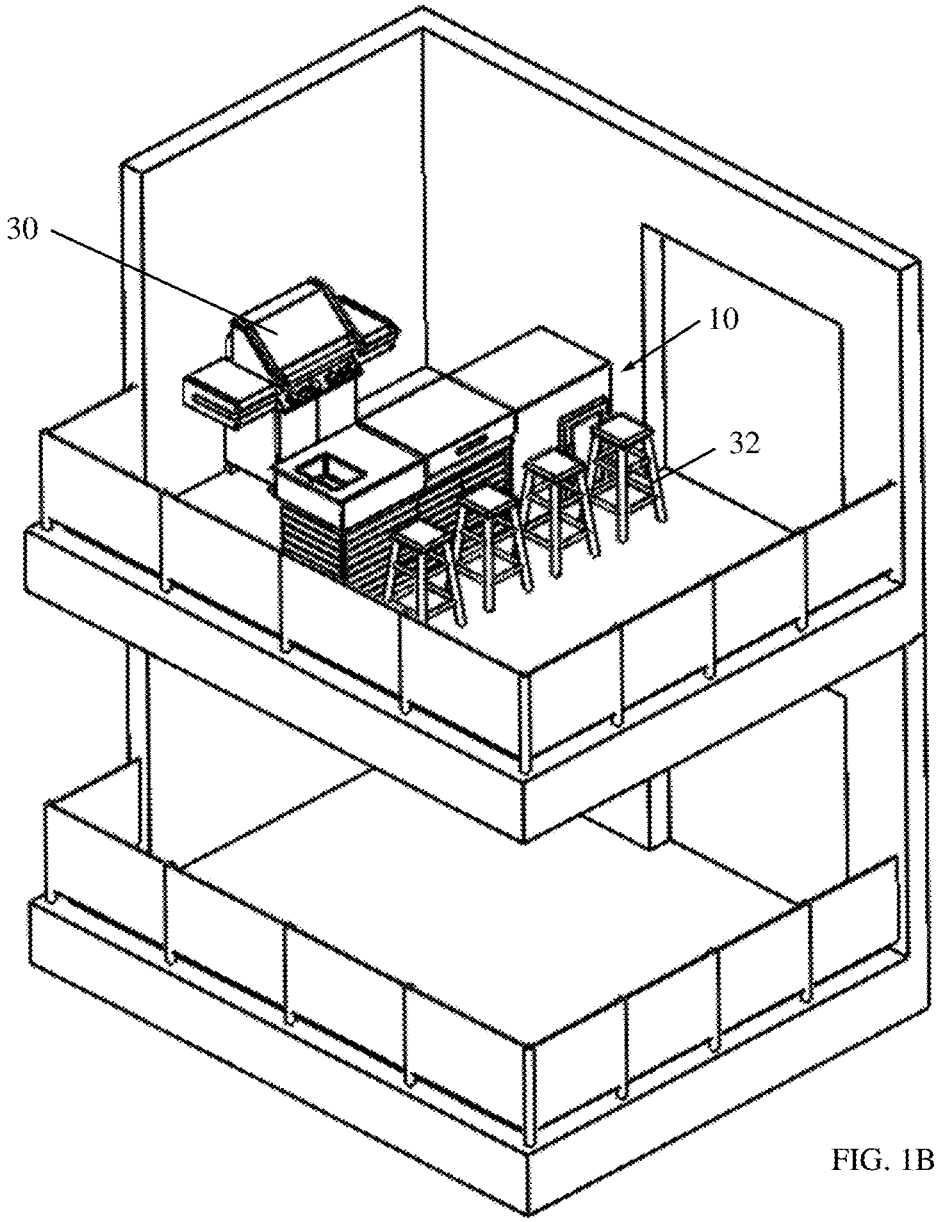

Reference is now made to FIGS. 1A and 1B, which illustrate the portable kitchen 10 in stored and expanded orientations, respectively. The portable kitchen 10 may include chairs and other furniture 32.

The portable kitchen 10 may be conveniently stored in the position of FIG. 1A and takes up minimal space on the patio, porch or other place. The portable kitchen 10 may be used both in the stored and expanded orientations.

Accordingly, the method of the invention includes providing kitchen assembly 10 that includes one or more supports 11, one or more side counters 16/18, which are supported by the one or more supports 11, central counter 20 and front panel 19 positioned sideways relative to the one or more supports 11, wherein there is a space 25 adjacent the one or more side counters 16/18 and behind the front panel 19 for receiving therein cooking appliance 30, and instructing to use the kitchen assembly 10 in one of two modes: a storage mode and a usage mode. In the usage mode the central counter 20 is placed above space 25 and is adjacent the one or more side counters 16/18 and the front panel 19, and the cooking appliance 30 is not in the space 25. In the storage mode the central counter 20 is moved away from the space 25 and the cooking appliance 30 is positioned in the space 25.

The portable kitchen 10 may be modular so that its dimensions can be changed to be larger or smaller to suit any particular need. For example, different size counters or cupboards can be supplied in a modular kit; additionally or alternatively, add-on counters or cupboards can be supplied.

The materials from which the different components of the portable kitchen 10 are made are limitless, such as but not limited to, metal (e.g., stainless steel, aluminum), wood, plastic, stone (natural or synthetic) and many others.

What is claimed is:

1. A method comprising:

providing a kitchen assembly that comprises one or more supports, one or more side counters, which are supported by said one or more supports, a central counter, and a front panel positioned sideways relative to said one or more supports, wherein there is a space adjacent said one or more side counters and behind said front panel for receiving therein a cooking appliance, said space being open to a rear of said kitchen assembly; and using said kitchen assembly in one of two modes, a storage mode and a usage mode, wherein in the usage mode the central counter is placed above said space and is adjacent said one or more side counters and said front panel, and said cooking appliance is not in said space, and wherein in the storage mode the central counter is moved away from said space and said cooking appliance is positioned in said space by being moved horizontally from the rear of said kitchen assembly into said space.

2. The method according to claim 1, wherein in the storage mode the central counter is placed over said one or more side counters.

3. The method according to claim 1, further comprising adding to said kitchen assembly a sink and a faucet.

4. The method according to claim 1, further comprising adding to said kitchen assembly a refrigerator or a cooling device.

5. The method according to claim 1, further comprising adding to said kitchen assembly cupboards or shelves.

6. The method according to claim 1, further comprising adding to said kitchen assembly a garbage bin.

7. The method according to claim 1, further comprising adding to said kitchen assembly a paper towel rack or rod.

8. The method according to claim 1, further comprising adding to said kitchen assembly chairs or furniture.

* * * * *